US005967239A

United States Patent [19]

Sprakel et al.

[11] Patent Number: 5,967,239

[45] Date of Patent: Oct. 19, 1999

[54] FIRE-EXTINGUISHING DEVICE WITH A FIRE-EXTINGUISHING FLUID

[75] Inventors: Dirk Sprakel, Odenthal-Altenberg; Jan Sprakel, Burscheid, both of Germany

[73] Assignee: Kamat-Pumpen GmbH & Co. KG, Witten-Annen, Germany

[21] Appl. No.: 08/945,568

[22] PCT Filed: Apr. 20, 1996

[86] PCT No.: PCT/EP96/01665

§ 371 Date: Jan. 20, 1998

§ 102(e) Date: Jan. 20, 1998

[87] PCT Pub. No.: WO96/33775

PCT Pub. Date: Oct. 31, 1996

[30] Foreign Application Priority Data

Apr. 22, 1995 [DE] Germany ..... 195 14 939

[51] Int. Cl.[6] ..... A62C 37/08; A62C 37/10; A62C 37/12

[52] U.S. Cl. ..... 169/37; 169/20; 169/38; 169/42; 169/56; 169/57; 169/60

[58] Field of Search ..... 169/20, 37, 38, 169/41, 42, 54, 56, 57, 58, 60

[56] References Cited

U.S. PATENT DOCUMENTS

| | | | |
|---|---|---|---|
| 3,791,450 | 2/1974 | Poitras | 169/37 |
| 5,513,708 | 5/1996 | Sundholm | 169/37 |
| 5,531,275 | 7/1996 | Sundholm | 169/37 X |
| 5,573,065 | 11/1996 | Sundholm | 169/38 X |

FOREIGN PATENT DOCUMENTS

WO 94/06517 3/1994 WIPO .

*Primary Examiner*—Andres Kashnikow
*Assistant Examiner*—Robin O. Evans
*Attorney, Agent, or Firm*—Proskauer Rose LLP

[57] ABSTRACT

A fire extinguishing device activates fire extinguishing nozzle-heads in multiple locations in response to fire-induced activation of one of the fire extinguishing nozzle-heads. The fire extinguishing nozzle-heads are connected to a supply pipe which conducts a fire extinguishing fluid from a pressure generator. Each nozzle-head includes at least one fire extinguishing nozzle and a fire detection contrivance, which, in the event of a fire, triggers the issue of the extinguishing fluid from the activated fire extinguishing nozzle. Each of the fire extinguishing nozzles-heads further includes at least two connecting channels providing communication between the fire extinguishing nozzles and a supply pipe. Both connecting channels are normally closed by respective shut-off devices while the extinguishing nozzle-heads are in a quiescent state. In the event of a fire, the heat generated thereby triggers the fire detection contrivance, which in turn opens a connecting channel by responsive operation of a corresponding one of the shut-off devices. In response to the attendant pressure drop, a signal is sent to the pressure generator which increases the pressure in the supply pipe. The other shut-off device is designed to open when a minimum pressure in the supply pipe is exceeded, and thereby activates the remaining fire extinguishing nozzle-heads not already directly activated in response to fire-related heat.

7 Claims, 2 Drawing Sheets

FIRE-EXTINGUISHING DEVICE WITH A FIRE-EXTINGUISHING FLUID

The present invention relates to a device for extinguishing fires by means of an extinguishing fluid comprising a supply pipe conducting the extinguishing fluid; the said supply pipe connecting a pump with a plural number of fire extinguishing nozzle-heads, each comprising at least one fire extinguishing nozzle; this nozzle being connected to the supply pipe by way of at least one connecting channel; and comprising a fire detection contrivance which, in the case of a fire, triggers the issue of extinguishing fluid from the fire extinguishing nozzles. In this at least with one of the fire extinguishing nozzle heads, the issue of extinguishing fluid from at least one of the extinguishing nozzles is closed off by a shut-off device which opens automatically when the minimum pressure of the extinguishing fluid is exceeded. Such fire extinguishing devices are stationary installations in buildings or ships. In addition, the invention relates to a fire extinguishing nozzle-head for a device of the type mentioned above for extinguishing fires.

Known devices are usually equipped with a pressure generator, for example a pump, for generating the extinguishing fluid pressure required for firefighting and with fire extinguishing nozzles arranged in the localities susceptible to fires; the said fire extinguishing nozzles are connected to the pressure generator by way of a system of supply pipes. In the case of a fire, the issue of extinguishing fluid from the fire extinguishing nozzles is triggered by a fire detection contrivance which is allocated to each of the fire extinguishing nozzles.

One problem when operating extinguishing devices of the type described above is that if a fire breaks out only in a limited area of a sector or an enclosed space, in each instance only the fire extinguishing nozzles allocated to the respective area are opened. This in turn leads to the danger that insufficient extinguishing fluid is supplied to the surroundings of the seat of the fire, so that the fire also encroaches upon the remaining areas of the sector, in spite of the fire extinguishing nozzles allocated to the seat of the fire being opened. In the case of a fire breaking out within a sector, it is thus necessary to open not only the fire extinguishing nozzles directly allocated to the seat of the fire, but all fire extinguishing nozzles installed in the sector. In order to meet these requirements, as a rule, complicated and expensive fire detection contrivances or control systems are used.

An extinguishing nozzle-head of the type described above is known from publication of the PCT application WO-A-94/16771. In the known fire extinguishing nozzle-head, the connecting channel by which the fire extinguishing nozzle is connected to the supply pipe, in the quiescent state is closed by a piston. This piston is supported by way of a helical spring on a glass vial as is normally used as a fire detection contrivance with these types of fire extinguishing nozzle-heads. The quiescent-state pressure of the extinguishing fluid present in the supply pipe impinges on the piston.

In the known fire extinguishing nozzle-head, the length of the spring is designed in such a way that in the case of a fire, the travel that becomes free as a result of the fire detector shattering, is sufficient to move the piston into its open position, with the spring being untensioned. At the same time, the force of the spring is such that in the case of an increase in the pressure in the supply pipe, the spring is compressed and the piston is moved in this way into its open position.

The known fire extinguishing nozzle-head allows significant simplification in the design and control of fire extinguishing devices where a plural number of fire extinguishing nozzle-heads must be opened depending on the location of the fire. Due to the close tolerance limits within which the spring and the piston must be designed and moved, the known fire extinguishing nozzle-head has been found to be prone to malfunction.

It is the object of the present invention, by simple and economic means to improve the reliability of a device for extinguishing fires, of the type mentioned in the introduction, and of a fire extinguishing nozzle-head used in such a device.

According to the invention, this object is met in regard to the device for extinguishing fires in that each of the fire extinguishing nozzles of the fire extinguishing nozzle-head is connected to the supply pipe by way of at least two connecting channels, with one of the connecting channels in its quiescent state being shut off by a first shut-off device which opens up if the minimum pressure of the extinguishing fluid is exceeded, and the other of the connecting channels in its quiescent state being shut off by a second shut-off device which in the case of a fire can be opened by the fire detection contrivance.

In regard to the fire extinguishing nozzle-head, this object is met in that the fire extinguishing nozzle, of which there is at least one, of the fire extinguishing nozzle-head is connected to the supply pipe by way of at least two connecting channels, with one of the connecting channels in its quiescent state being shut off by a first shut-off device which opens up if the minimum pressure of the extinguishing fluid is exceeded, and the other of the connecting channels in its quiescent state being shut off by a second shut-off device which is coupled to the fire detection contrivance in such a way that, in the case of a fire, the fire detection contrivance causes the second shut-off device to open.

According to the invention it is provided that, corresponding to the existing art known from the above-mentioned PCT application, the issue of extinguishing fluid from the fire extinguishing nozzle-head can be effected alone by switching on the pressure generator connected to the fire extinguishing nozzle-head, for example following a respective signal from the fire detection contrivance. After switching on the pump, the pressure within the supply pipe system increases. When a certain limit pressure is exceeded, the shut-off device activated by exceeding the minimum pressure automatically opens.

Since with the fire extinguishing device according to the invention, two connecting channels for connecting the fire extinguishing nozzle of the fire extinguishing nozzle-head designed accordingly, to the supply channel, are provided, two shut-off devices operating totally separately from each other without influencing each other, can be used. It is thus possible without any problem to optimally adapt each of these shut-off devices to its respective requirement. In this way it is assured that in the case of a fire, devices according to the invention, and in particular the fire extinguishing nozzle-heads designed according to the invention used in them, provide a high degree of operational safety and reliability.

The opening of the shut-off device, in the case of a fire, by the fire detection contrivance which is connected to the said fire detection contrivance and the resulting issue of extinguishing fluid from the fire extinguishing nozzle, causes a drop in pressure in the supply pipe. This drop in pressure can be detected by a control and monitoring system allocated to the pressure generator; the said control and monitoring system then activates the pressure generator. Alternatively, it is also possible to evaluate the increase in flow speed in the supply pipe as a signal for switching the pressure generator on. Switching on the pressure generator results in an increase in the pressure of the fluid to the point where the minimum pressure is exceeded. This exceeding of the minimum pressure causes an opening of the shut-off devices with other fire extinguishing nozzle-heads, designed according to the invention, which are also connected to the supply pipe, which automatically open when a minimum pressure is exceeded. By means of fire extinguishing nozzle-heads designed according to the invention, an extinguishing device can be constructed which is safe and activated only by triggering a single fire extinguishing nozzle-head of the fire detection contrivance.

Since in the case of extinguishing devices equipped with fire extinguishing nozzle-heads designed according to the invention neither additional supply pipes nor expensive fire detection or control systems are needed in order to ensure, in the case of a fire, opening of all the fire extinguishing nozzles meeting the above-mentioned requirements, such a device can be set up economically. In particular it is also possible to convert existing systems by retrofitting them with fire extinguishing nozzle-heads designed according to the invention.

As is the case with existing art, the fire detection contrivance should also preferably be an element, destroyable by the effect of heat, on which a movable valve piston is spring-supported; this spring-supported valve piston comprising a shut-off device openable by the fire detection contrivance. In this way the fire detection contrivance and the respective shut-off device can be realised easily using very little space. This is the case in particular if the element, destroyable by the effect of heat, is a glass vial.

The fire extinguishing nozzle-head according to the invention can be used in a particularly advantageous way if the fire extinguishing nozzles create an extinguishing mist from the extinguishing fluid. When using an extinguishing mist made from an extinguishing fluid, a fire can be extinguished with a minimum of extinguishing fluid.

With a fire extinguishing head according to the invention, the costs can be kept particularly low, while at the same time operational safety and robustness are kept high, in that the shut-off device openable by an increase in pressure of the extinguishing fluid comprises a bursting disk. By respective selection of the materials and by suitable dimensioning, such bursting disks can easily be adapted to the respective operating conditions.

Alternatively or in addition, the shut-off device, opening as a result of an increase in pressure of the extinguishing fluid, can be designed as a movable valve body loaded by elastic restoring force, which valve body comprises at least a first pressure surface upon which the fluid exerts pressure essentially directed against the restoring force. This embodiment of the invention can be used with particular advantage in those cases where the connecting channel leads to a chamber surrounding the first pressure surface and where a connecting channel leading to the chamber can be shut off by way of a section of the first pressure surface. Alternatively or in addition, by a single movement of the valve body, it should be possible to open at least one of the connecting channels, and it should be possible to shut off at least one further connecting channel. In both cases it is possible, depending on the pressure present in the supply pipe, to control the issue of extinguishing fluid from various nozzles. This is particularly advantageous if the device according to the invention is used for firefighting with extinguishing fluid mist, because in this case the composition of the extinguishing mist can be controlled in a simple manner.

Below, the invention is illustrated in more detail by means of a drawing representing two embodiments, as follows.

Figure 1:
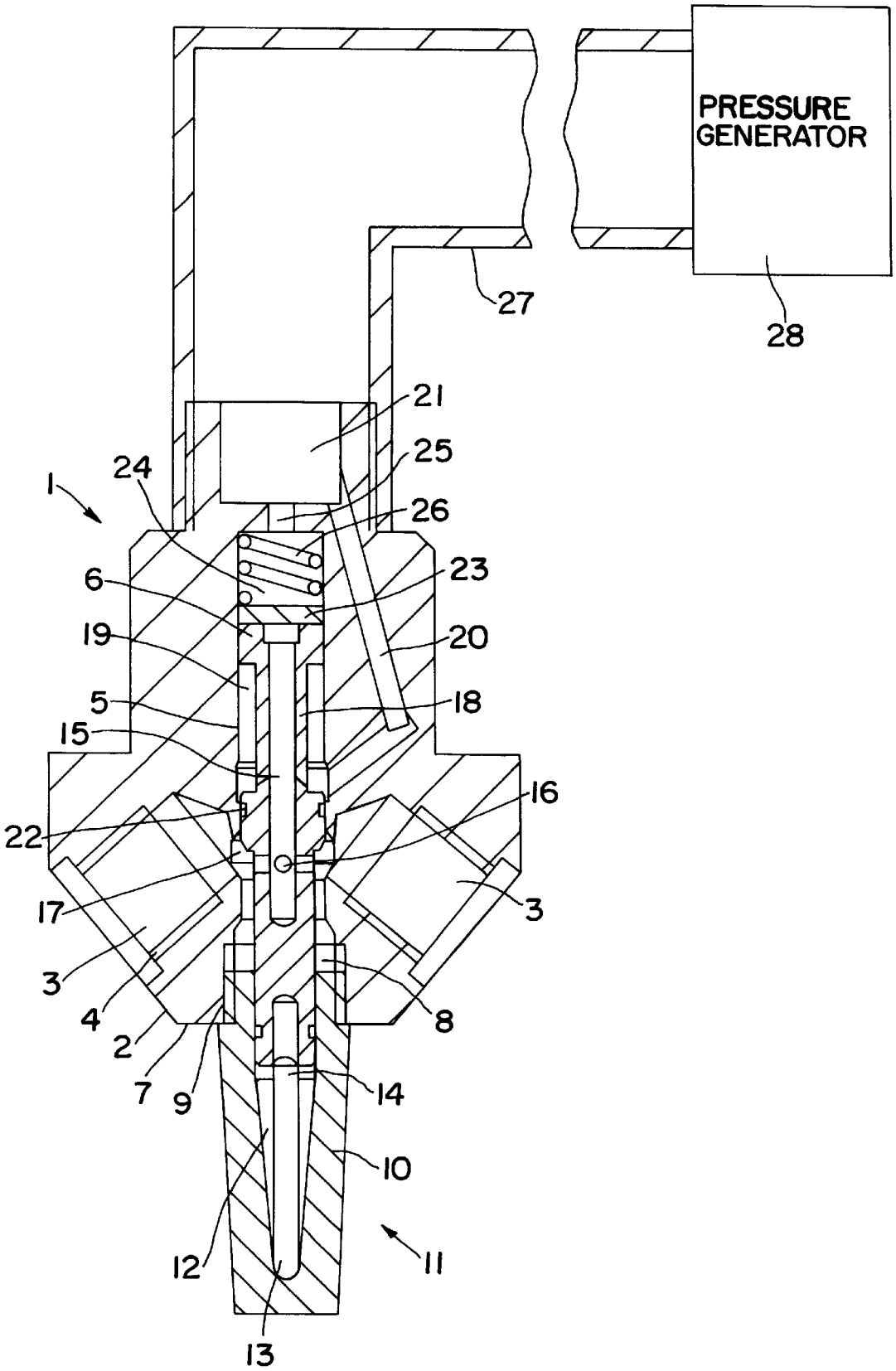
FIG. 1 shows a first fire extinguishing nozzle-head in axial longitudinal section.

The fire extinguishing nozzle-head shown in FIG. 1 comprises a conically bevelled circumferential area 2 into which retainers 3 for fire extinguishing nozzles (not shown) are shaped. For this purpose, the retainers 3 comprise internal screw threads 4 into which the fire extinguishing nozzles can be screwed by means of respective external threads on the said fire extinguishing nozzles. Apart from the retainers 3 for the fire extinguishing nozzles (not shown), the fire extinguishing nozzle-head 1 comprises a central bore hole 5 in which an axially movable valve piston 6 is arranged. In the area of the face 7 of the fire extinguishing nozzle-head 1, the bore hole 5 comprises a section 8 with a larger diameter when compared to the remaining sections of the bore hole 5, with an internal screw thread 9 formed in its wall. The protective cap 10 of a fire detection contrivance 11 is screwed into the internal screw thread 9.

The protective cap 10 of the fire detection contrivance 11 protrudes freely into the space from the face 7 of the fire extinguishing nozzle-head. A piston-shaped glass vial 13 is inserted into the internal recess 12 of the protective cap 11; at the end 14 of the said glass vial allocated to the fire extinguishing nozzle-head 1, the valve piston 6 is supported.

The valve piston 6 comprises an axial blind hole 15, emanating from the rear face, allocated to the bottom 14 of the bore hole 5, of the said valve piston. Through-bore holes 16, arranged in radial direction to the circumferential area of the valve piston 6, in the middle area of the valve piston 5, lead into the said blind hole 15. The through-bore holes 16 connect the blind hole 15 of the valve piston 6 with an annular chamber 17 shaped into the bore hole 5. The retainer 3 for the fire extinguishing nozzles (not shown) are shaped into the said annular chamber.

In addition, the valve piston 6 in its rear area comprises a section 18 with a diameter reduced to such an extent that a clear space 19 is created in the central bore hole 5 of the fire extinguishing nozzle-head 1. A connecting channel 20 leads into this clear space 19. A connection 21, shaped at the rear of the fire extinguishing nozzle-head, for a supply pipe 27, is connected with the central bore hole 5 of the fire extinguishing nozzle-head 1 by way of the connecting channel 20. In the quiescent state, as shown in FIG. 1, of the fire extinguishing nozzle-head 1, the clear space 19 of the central bore hole 5 is sealed towards the annular chamber 17 by an annular seal 22 borne by the valve piston 6.

The blind hole 15 of the valve piston 6 is sealed, by a bursting disk 23, against a rearward clear space 24 of the central bore hole 5 of the fire extinguishing nozzle-head 1 which is provided between the bursting disk 23 and the bottom 14 of the central bore hole 5. Seated in the clear space 24 there is a helical spring 26 which in the quiescent state of the fire extinguishing nozzle-head 1 exerts a spring force, directed towards the glass vial 13, on the valve piston 6. In addition a second connecting channel 25 which connects the clear space 24 of the central bore hole 5 with the connection 21 for the supply pipe 27 leads to the clear space 24.

Figure 2:
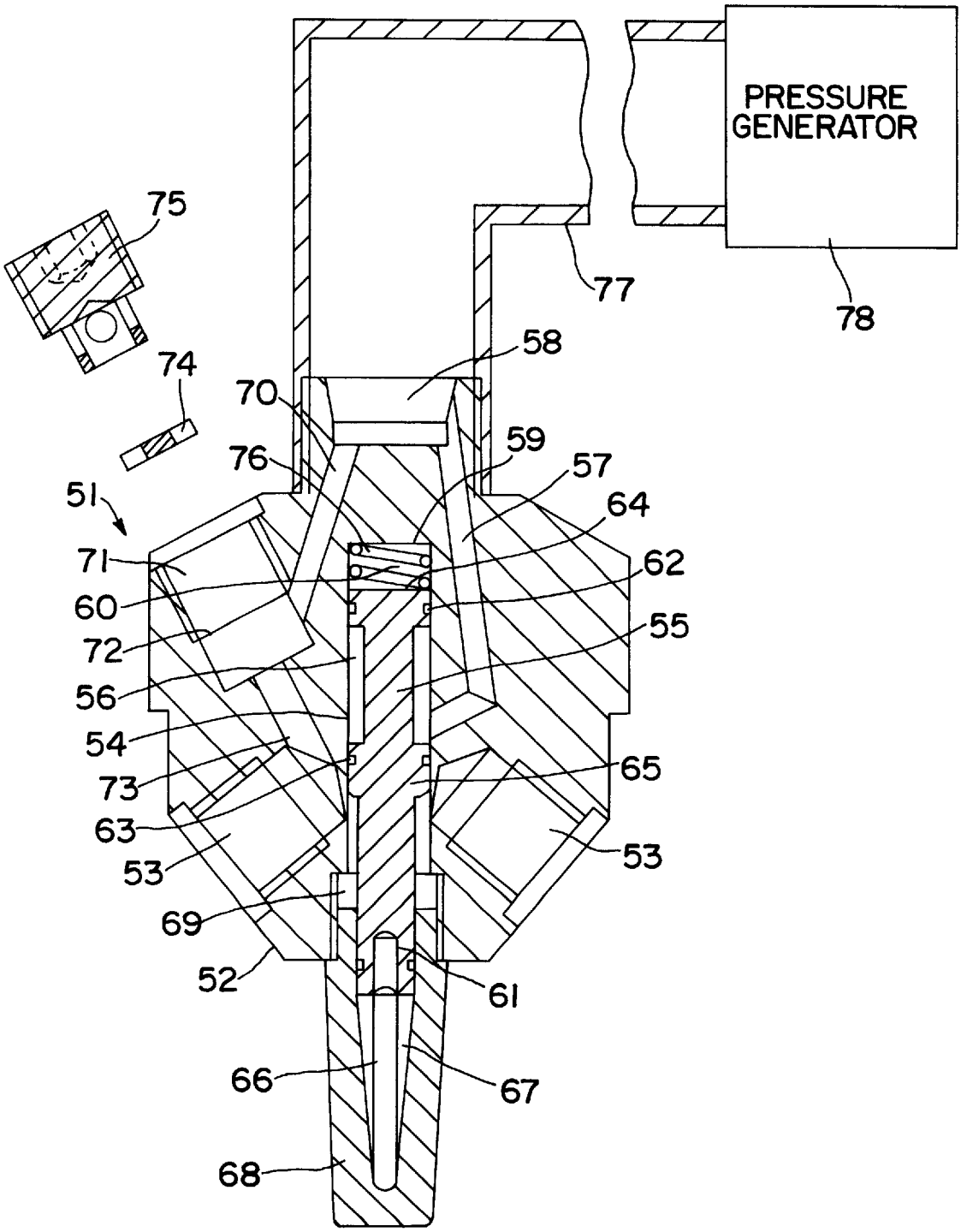
FIG. 2 shows a second fire extinguishing nozzle-head in axial longitudinal section.

The fire extinguishing nozzle-head 51 shown in FIG. 2 comprises retainers 53, shaped into its conically bevelled circumferential area 52; extinguishing nozzles (not shown) can be screwed into the said retainers. As is the case with fire extinguishing nozzle-head 1 of FIG. 1, the fire extinguishing nozzle-head 51 comprises a central bore hole 54 in which a piston 55 is arranged in an axially movable manner. The piston 55 is shaped in the same way as the piston 6 shown in FIG. 1. Accordingly, a clear space 56 is created by a section with a reduced diameter arranged at the rear of the piston 55. A first connecting channel 57 leads into this clear space. The other end of the connecting channel 57 is connected to a connection 58 for a supply pipe 77.

A clear space 60 is provided between the rear end of the piston 55 and the bottom 59 of the bore hole 54. A helical spring 76, which exerts pressure on the piston 55 in the direction of the tip 61 of the said piston 55, is arranged in the clear space 60.

The clear space 56 is sealed against the remaining sections of the central bore hole 54 by means of annular seals 62, 63 inserted into grooves which are provided in the rearward end section 64 or the middle section 65 of the piston 55.

The tip 61 of the piston 55 is resting against a glass vial 66 seated in the recess 67 of a protective cap 68. As is the case with cap 11 shown in FIG. 1, the protective cap 68 is screwed into the diameter-enlarged frontal section 69 of the central bore hole 54.

The retainers 53 for the fire extinguishing nozzles (not shown) are connected to the cental bore holes 54 by connecting channels (not shown) in such a way that in the quiescent state as shown in FIG. 2, the connecting channel 57 is sealed off against the retainers 53.

The connection 58 for the supply pipe 77 is connected to a further retainer 71 by way of a second connecting channel 70. A further connecting channel 73 is shaped into the bottom 72 of the retainer 71; the said connecting channel connects the retainer 71 to the retainers 53 for the extinguishing nozzles (not shown). A bursting disk 74 can be inserted into the retainer 71 in such a way that the bursting disk 74 rests against the bottom 72 of the retainer 71 and seals off the connecting channel 73. The retainer 71 is closed off by a plug 75 which can be screwed into the retainer 71; at the same time the plug 75 ensures that the bursting disk 74 is held to the bottom 72 of the retainer 71.

The device, described here, according to the invention, for extinguishing fires by means of an extinguishing fluid, comprises a plural number of fire extinguishing nozzle-heads 1 or 51 which are arranged, spaced apart from each other, in an area susceptible to fires. The fire extinguishing nozzle-heads 1 or 51 are connected, by way of supply pipes 27 or 77, to a pressure generator 28 or 78, for example a pump or a pressure cylinder. In this, the pressure of the extinguishing fluid within the supply pipe system is controlled by a surveillance and control system (not shown). In the quiescent state of the device, the pressure in the supply pipe system is relatively low at for example 5 to 8 bar.

If a fire does occur, a device equipped with the fire extinguishing nozzle-heads 1 shown in FIG. 1 works as follows:

Due to the effect of the heat generated when a fire occurs, the glass vial 13 of the fire extinguishing nozzle-head 1 in closest proximity to the place where the fire is occurring, is destroyed. Subsequently, as a result of the spring force of the spring 26, the piston 6 is moved in the direction of the front 7 of the fire extinguishing nozzle-head 1. As a result of this movement, the first connecting channel 20 is connected to the retainers 3 by way of the clear space 19 and the annular chamber 17, so that extinguishing fluid emanates from the fire extinguishing nozzles screwed into the retainers 3.

The drop in pressure in the supply pipe system, associated with the issue of extinguishing fluid, is detected by the monitoring and control system (not shown). Subsequently the said monitoring and control system transmits a control signal to the pressure generator 28 which subsequently increases the pressure of the extinguishing fluid within the supply pipe system again. As soon as the pressure within the supply pipe system reaches a defined limit value, for example 40 bar, the bursting disks 23 burst on those fire extinguishing nozzle-heads where the glass vials 14 had not been destroyed when the fire started. Subsequently, extinguishing fluid reaches the retainer 3 by way of the second connecting channel 25, the blind bore hole 15, the through-bore hole 16 and the annular chamber 17; the extinguishing fluid then emanates from the fire extinguishing nozzles (not shown). From this moment onwards, all the fire extinguishing nozzles contribute to the firefighting effort and safely prevent any spreading of the fire to areas adjacent to the fire. In this, due to the short time required for increasing the pressure within the supply pipe system, the time lapse between the destruction of the glass vial 13 of the fire extinguishing nozzle-heads 1 in closest proximity to the fire, and the bursting of the bursting disks 13 of the other respective fire extinguishing nozzle-heads 1, is short enough to meet the legal requirements.

In principle, a device equipped with fire extinguishing nozzle-heads 51 of the type described here, functions in the same manner as the device mentioned above, equipped with fire extinguishing nozzle-heads 1. With the fire extinguishing nozzle-heads 51, too, during destruction of the glass vial 66 the first connecting channel 57 is connected as a result of the movement of the piston 55 associated with the destruction of the glass vial 66, with the retainers 53, by way of the clear space 56 and the annular channel (not shown), From this moment onwards, extinguishing fluid emanates from the fire extinguishing nozzles (not shown) screwed into the recesses 53.

With those fire extinguishing nozzle-heads 51 where the effect of the heat associated with the start of the fire did not destroy the glass vials 66, the bursting disk 74 bursts as soon as the pressure within the supply pipe system, by way of the pressure generator (not 78) activated by the control and monitoring system, has exceeded a particular limit value. Once the fire has been extinguished, it is particularly easy to replace the bursting disk 74 that may have been destroyed, by unscrewing the plug 75.

The above explanations always refer to devices which may be equipped with any fire extinguishing nozzles. However, the device according to the invention is particularly suitable for those fire extinguishing nozzles which generate a fluid mist from the extinguishing fluid.

We claim:

1. A device for extinguishing fires by means of an extinguishing fluid, comprising:

a pressure generator for supply of the extinguishing fluid;

fire extinguishing nozzle-heads;

a supply pipe for conducting the extinguishing fluid from the pressure generator to the fire extinguishing nozzles;

each of the fire extinguishing nozzle-heads comprising at least one fire extinguishing nozzle and a fire detection contrivance triggered by the presence of heat produced in the event of a fire;

each of the fire extinguishing nozzle-heads further including a first shut-off device, a second shut-off device, and at least two connecting channels providing communication between the fire extinguishing nozzles and the supply pipe, one of the connecting channels being closed by the first shut-off device while said fire extinguishing nozzle-head is in a quiescent state and said extinguishing fluid is below a minimum pressure, said first shut-off device opening when the minimum pressure is exceeded, and another of the connecting channels being closed by the second shut-off device while in said quiescent state, and which is opened in response to triggering of said fire detection contrivance, opening of either of said connecting channels in a particular fire extinguishing nozzle-head resulting in issue of the extinguishing fluid from the at least one fire extinguishing nozzle.

2. The device according to claim 1, wherein the first shut-off device is a bursting disk.

3. A fire extinguishing nozzle-head for a device for extinguishing fires by means of an extinguishing fluid delivered via a supply pipe from a pressure generator, comprising:

at least one fire extinguishing nozzle;

at least two connecting channels providing communication between the fire extinguishing nozzles and the supply pipe;

a fire detection contrivance which is triggered in the presence of heat generated in the event of a fire; and a first shut-off device for closing one of the connecting channels while said extinguishing fluid is below a minimum pressure, said first shut-off device opening when the minimum pressure is exceeded; and a second shut-off device for normally closing another of the connecting channels, said second shut-off device being coupled to the fire detection contrivance in a manner causing the second shut-off device to open in response to triggering of the fire detection contrivance.

4. The fire extinguishing nozzle-head according to claim 3, wherein:

the fire detection contrivance is an element destructible by the effect of heat; and the second shut-off device coupled to the fire detection contrivance includes a movable valve piston supported on the element and spring biased thereagainst.

5. The fire extinguishing nozzle-head according to claim 4, wherein the fire detection contrivance is a glass vial.

6. The fire extinguishing nozzle-head according to claim 3, wherein the fire extinguishing nozzles generate an extinguishing mist from the extinguishing fluid.

7. The fire extinguishing nozzle-head according to claim 3, wherein the first shut-off device is a bursting disk.

* * * * *